US010684049B2

(12) United States Patent
Yoon et al.

(10) Patent No.: US 10,684,049 B2
(45) Date of Patent: Jun. 16, 2020

(54) OIL SEPARATOR AND AIR CONDITIONER INCLUDING AN OIL SEPARATOR

(71) Applicant: LG ELECTRONICS INC., Seoul (KR)

(72) Inventors: Pilhyun Yoon, Seoul (KR); Yongcheol Sa, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 268 days.

(21) Appl. No.: 14/876,048

(22) Filed: Oct. 6, 2015

(65) Prior Publication Data

US 2016/0116196 A1 Apr. 28, 2016

(30) Foreign Application Priority Data

Oct. 27, 2014 (KR) ..... 10-2014-0145734

(51) Int. Cl.

*F25B 43/02* (2006.01)
*F25B 49/02* (2006.01)
*F25B 31/00* (2006.01)

(52) U.S. Cl.

CPC ..... *F25B 43/02* (2013.01); *F25B 31/004* (2013.01); *F25B 49/02* (2013.01); *F25B 2500/16* (2013.01); *F25B 2600/2515* (2013.01)

(58) Field of Classification Search

CPC ..... F25B 43/02; F25B 31/004; F25B 49/02; F25B 2600/2515; F25B 2500/16

See application file for complete search history.

(56) References Cited

U.S. PATENT DOCUMENTS 2,665,557 A * 1/1954 Dodson ..... F25B 43/02 62/193
5,029,455 A 7/1991 Backus et al.
(Continued)

FOREIGN PATENT DOCUMENTS

CN 1585880 2/2005
CN 201184715 1/2009
(Continued)

OTHER PUBLICATIONS

Endo, Air Conditioner, Jan. 12, 1996, JPH085167A, Whole Document.*

(Continued)

*Primary Examiner* — Larry L Furdge
(74) *Attorney, Agent, or Firm* — Ked & Associates LLP

(57) ABSTRACT

An oil separator and an air conditioner including an oil separator are provided. The oil separator may include a housing including a suction tube that guides a refrigerant, in which an oil may be mixed, into the housing and a discharge tube that discharges refrigerant separated from the refrigerant, in which the oil may be mixed, to the outside, a first collection tube that communicates with a lower portion of the housing to discharge the oil separated from the oil to a compressor, a second collection tube that communicates with a side surface of the housing to discharge the oil separated from the refrigerant to the compressor, and a control valve provided in communication with the first collection tube or the second collection tube to control a flow of the oil through the first collection tube or the second collection tube.

17 Claims, 8 Drawing Sheets

(56) References Cited

U.S. PATENT DOCUMENTS

| | | | | |
|---|---|---|---|---|
| 2012/0304685 | A1* | 12/2012 | Kiguchi | F24F 1/26 62/468 |
| 2014/0130539 | A1 | 5/2014 | Yoon et al. | |

FOREIGN PATENT DOCUMENTS

| | | | | |
|---|---|---|---|---|
| CN | 103277952 | | | 9/2013 |
| EP | 2 730 862 | A1 | | 5/2014 |
| JP | H08-005167 | A | | 1/1996 |
| JP | H085167 | A | * | 1/1996 |
| JP | 2003-42599 | A | | 2/2003 |
| JP | 2012-145251 | A | | 8/2012 |
| JP | 2012145251 | A | * | 8/2012 |
| KR | 10-2013-0043977 | A | | 5/2013 |
| KR | 10-2014-0060699 | A | | 5/2014 |

OTHER PUBLICATIONS

Uchino et al., Heat Pump Device, Aug. 2, 2012, JP2012145251A, Whole Document (Year: 2012).*
European Search Report dated Mar. 1, 2016 issued in Application No. 15189920.0.
Korean Office Action issued in Application 10-2014-0145734 dated Sep. 23, 2015.
Chinese Office Action dated Jul. 3, 2017 (English Translation).

* cited by examiner

OIL SEPARATOR AND AIR CONDITIONER INCLUDING AN OIL SEPARATOR

CROSS-REFERENCE TO RELATED APPLICATION(S)

The present application claims priority to Korean Patent Application No. 10-2014-0145734, filed in Korea on Oct. 27, 2014, which is herein incorporated by reference in its entirety.

BACKGROUND

1. Field

An oil separator and an air conditioner including an oil separator are disclosed herein.

2. Background

In general, air conditioners are apparatuses that adjust an indoor temperature to promote a pleasant indoor environment. Such an air conditioner may include an indoor unit or device installed in an indoor space and an outdoor unit or device that supplies a refrigerant into the indoor device. At least one indoor device may be connected to the outdoor device.

The air conditioner may supply the refrigerant into the indoor device to perform a cooling or heating operation. The cooling or heating operation of the air conditioner may be determined according to a flow of a circulating refrigerant. That is, the air conditioner may perform the cooling operation and the heating operation according to the flow of the refrigerant.

A flow of the refrigerant when the air conditioner performs the cooling operation will be described. The refrigerant compressed in a compressor of the outdoor device may be changed into a middle-temperature, high-pressure liquid refrigerant by passing through a heat exchanger of the outdoor device. When the liquid refrigerant is supplied into the indoor device, the refrigerant may be expanded in a heat exchanger of the indoor device, and thus, may be evaporated. A temperature of surrounding air of the heat exchanger of the indoor device may drop due to evaporation of the refrigerant. Also, when a fan of the indoor device rotates, surrounding air having a reduced temperature of the heat exchanger of the indoor device may be discharged into an indoor space.

Next, a flow of the refrigerant when the air conditioner performs the heating operation will be described. When a high-temperature, high-pressure gas refrigerant is supplied from the compressor of the outdoor device to the indoor device, the high-temperature, high-pressure gas refrigerant may be liquefied in the heat exchanger of the indoor device. Energy emitted due to liquefaction of the refrigerant may allow the surrounding air of the heat exchanger of the indoor device to increase in temperature. Also, when the fan of the indoor device rotates, the surrounding air having an increased temperature of the heat exchanger of the indoor device may be discharged into the indoor space.

The compressor provided in the outdoor device may compress the refrigerant to change the refrigerant into a high-temperature, high-pressure gaseous refrigerant. When the compressor operates, oil may be discharged with the refrigerant from the compressor, and the refrigerant and the oil may be separated from each other in an oil separator. The oil separated by the oil separator may be collected into the compressor through an oil collection tube.

However, if a relatively small amount of oil is collected from the oil separator to the compressor, an oil shortage within the compressor may occur, causing a breakdown of the compressor. On the other hand, if a relatively large amount of oil is collected from the oil separator to the compressor, the refrigerant and the oil may be compressed together with each other when the compressor operates, deteriorating an efficiency of the compressor.

Background technology of the present application is disclosed in Korean Patent Publication No. 2013-0043977, which is hereby incorporated by reference.

BRIEF DESCRIPTION OF THE DRAWINGS

Embodiments will be described in detail with reference to the following drawings in which like reference numerals refer to like elements, and wherein.

DETAILED DESCRIPTION

Hereinafter, an oil separator according to an embodiment and an air conditioner including an oil separator will be described with reference to the accompanying drawings.

Figure 1:
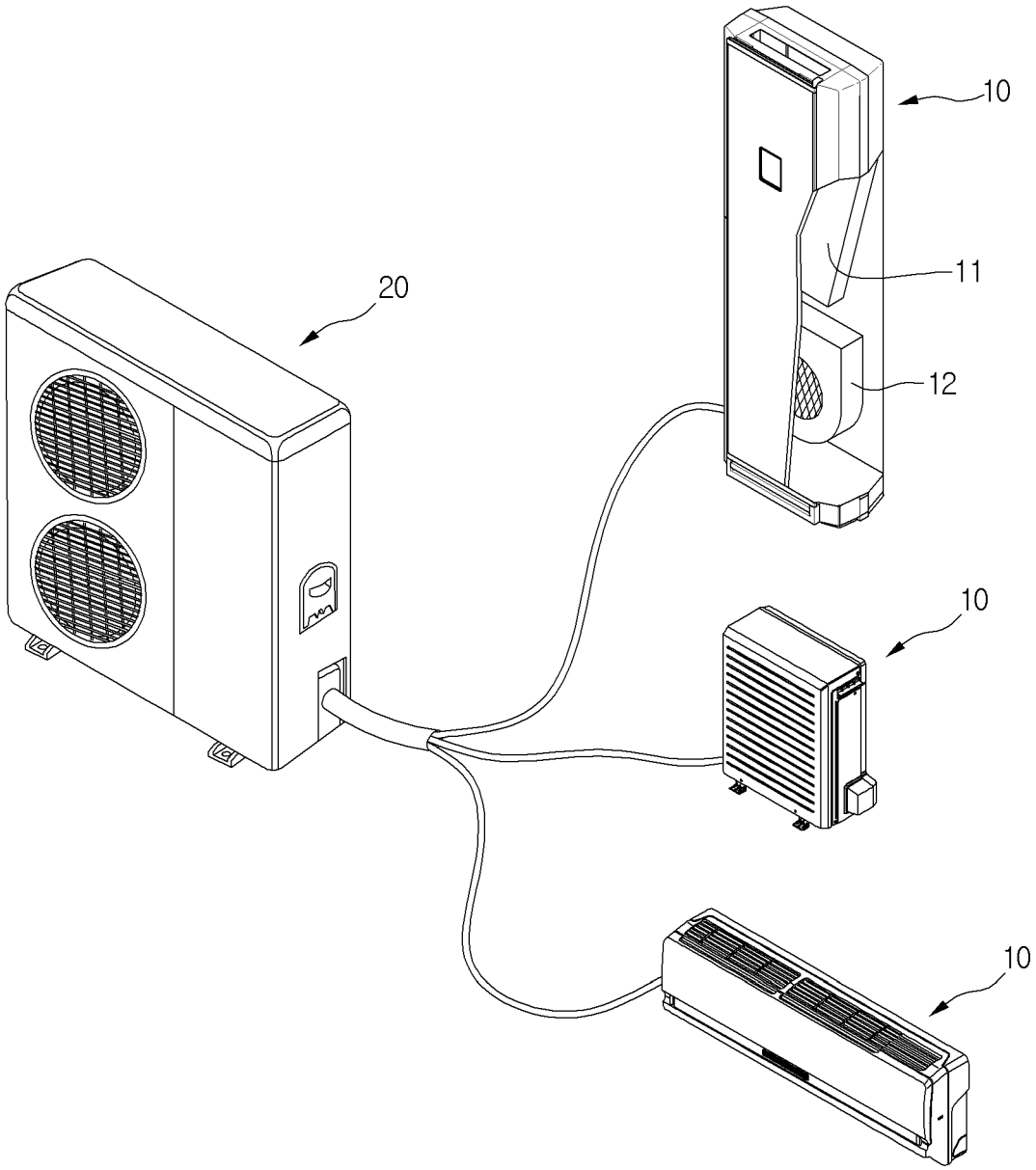
FIG. 1 is a perspective view of an air conditioner according to an embodiment.

FIG. 1 is a perspective view of an air conditioner according to an embodiment. Referring to FIG. 1, the air conditioner may include one or more indoor unit or device 10 and an outdoor unit or device 20.

The air conditioner may be classified into a standing-type air conditioner, a wall mount-type air conditioner, and a ceiling-type air conditioner according to a shape of the indoor device 10. However, embodiments are not limited thereto. For example, the indoor device 10 and the outdoor device 20 may be integrated with each other.

The indoor device 10 may discharge heat-exchanged air into an indoor space. The outdoor device 20 may be connected to the indoor device 10 to transfer a refrigerant required for conditioning air in the indoor device 10 into the indoor device 10.

The outdoor device 20 and the indoor device 10 may be connected to a refrigerant tube to discharge cold or hot air from the indoor device 10 to the indoor space according to circulation of the refrigerant. A plurality of the indoor device 10 may be provided, and the plurality of indoor devices 10 may be connected to the outdoor device 20.

The indoor device(s) 10 and the outdoor device 20 may be connected to each other through a communicable cable to transmit or receive a control command therebetween according to a predetermined communication manner. The air conditioner may further include a remote controller (not shown) that controls the indoor device(s) 10 and the outdoor device 20. The air conditioner may further include a local controller (not shown) connected to the indoor device(s) 10 to input a user's command and output an operation state of the indoor device(s) 10.

The air conditioner may further include at least one unit or device selected from a ventilation unit or ventilator, an air cleaning unit or cleaner, a humidification unit or humidifier, a dehumidification unit or dehumidifier, and a heater. Also, a lighting unit or device, and a warning unit or device may be connected to, interlocked with, or in communication with the remote controller (not shown) to operate based on a signal therefrom.

Each indoor device 10 may have an air suction hole through which indoor air may be suctioned and a discharge hole through which air heat-exchanged in the indoor device 10 may be discharged. The indoor device 10 may include a wind direction adjustment unit or adjuster provided in the discharge hole. The wind direction adjuster may open or close the discharge hole and control a direction of the air discharged from the discharge hole. The indoor device 10 may adjust an amount of air discharged from the discharge hole.

The indoor device 10 may include a vane installed in the air suction hole or the air discharge hole. The vane may open or close at least one of the air suction hole and the air discharge hole to guide a flow of air.

Hereinafter, internal components of the indoor and outdoor devices of the air conditioner will be described.

Figure 2:
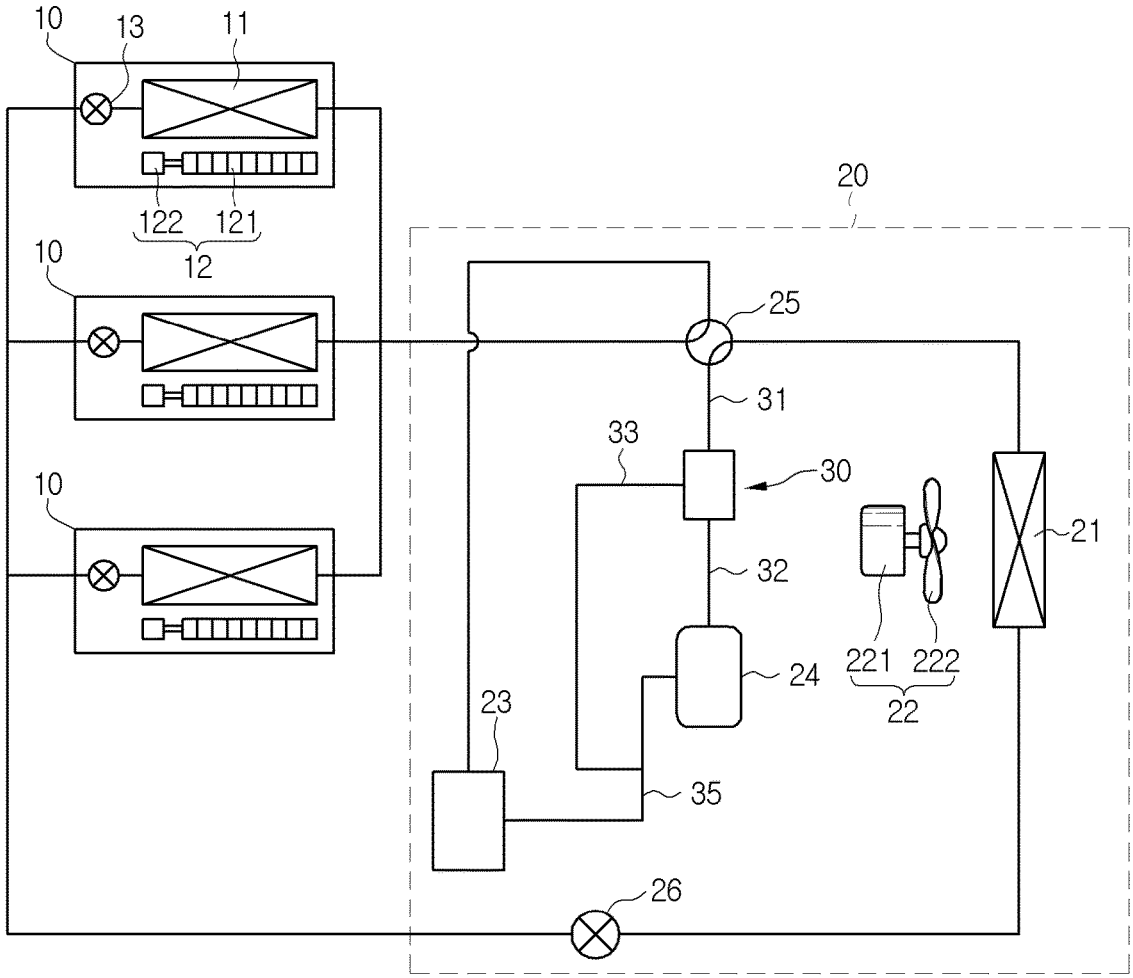
FIG. 2 is a schematic diagram of the air conditioner of FIG. 1.

FIG. 2 is a schematic diagram of the air conditioner of FIG. 1. Referring to FIG. 2, the outdoor device 20 may include an outdoor heat exchanger 21, in which outdoor air and the refrigerant may be heat-exchanged with each other, an outdoor blowing fan 22 that blows the outdoor air into the outdoor heat exchanger 21, an accumulator 23 that extracts only a gas refrigerant, a compressor 24 that compresses the gas refrigerant extracted by the accumulator 23, a four-way valve 25 that converts a flow direction of the refrigerant, and an outdoor electronic expansion valve 26, which may be controlled according to supercooling and superheating degrees when the air conditioner performs a heating operation.

When the air conditioner performs a cooling operation, the outdoor heat exchanger 21 may serve as a condenser in which gas refrigerant transferred into the outdoor heat exchanger 21 may be condensed by outdoor air. When the air conditioner performs the heating operation, the outdoor heat exchanger 21 may serve as an evaporator in which liquid refrigerant transferred into the outdoor heat exchanger 21 may be evaporated by outdoor air.

The outdoor blowing fan 22 may include an outdoor electronic motor 221 that generates power, and an outdoor fan 222 connected to the outdoor electronic motor 221 to be rotated by the power of the outdoor electronic motor 221, thereby generating a blowing force.

The compressor 24 may include an inverter compressor and a fixed speed compressor. The inverter compressor and the fixed speed compressor may not be limited in number.

The air conditioner may include a plurality of the outdoor device 20. In more detail, the outdoor device 20 may include a main outdoor unit or device and an auxiliary outdoor unit or device. Each of the main outdoor device and the auxiliary outdoor device may be connected to the indoor device 10.

The main outdoor device may operate to correspond to a number of indoor devices 10 that operate first among the plurality of indoor devices 10. If a cooling or heating capacity varies to exceed a capacity of the main outdoor device, the auxiliary outdoor device may operate. That is, a number of operating outdoor devices 20 and an operation of the compressor 24 provided in the outdoor device 20 may vary according a cooling or heating capacity required in the plurality of indoor devices 10.

Each indoor device 10 may include an indoor heat exchanger 11, in which indoor air may be heat-exchanged with the refrigerant, an indoor blowing fan 12 that blows the indoor air into the indoor heat exchanger 11, and an indoor electronic expansion valve 13, which may function as an indoor flow rate adjuster controlled according to supercooling and superheating degrees. When the air conditioner performs the cooling operation, the indoor heat exchanger 11 may serve as an evaporator in which liquid refrigerant transferred into the indoor heat exchanger 11 may be evaporated by indoor air. When the air conditioner performs the heating operation, the indoor heat exchanger 11 may serve as a condenser in which gas refrigerant transferred into the indoor heat exchanger 11 may be condensed by indoor air.

The indoor blower 12 may include an indoor electronic motor 122 that generates power, and an indoor fan 121 connected to the indoor electronic motor 122 to be rotated by the indoor electronic motor 122, thereby generating a blowing force. The air conditioner may be function as a cooler that cools the indoor space or a heat pump that cools or heats the indoor space.

When the air conditioner performs the cooling or heating operation, the refrigerant may pass through the refrigerant tube while circulating along one refrigerant cycle. When the air conditioner operates, the refrigerant compressed by the compressor 24 to change into a high-temperature, high-pressure gas refrigerant may be introduced into an oil separator 30 along a suction tube 32 together with oil discharged from the compressor 24. The refrigerant, which may be introduced into the oil separator 30 and mixed with oil, may be separated from the oil, and then the separated refrigerant may be discharged into a discharge tube 31. The oil separated in the oil separator 30 may move along an oil collection tube 33. The oil collection tube 33 may communicate with a guide tube 35 that guides introduction of the refrigerant into the compressor 24. Thus, the oil guided along the oil collection tube 33 may be mixed with the refrigerant passing through the guide tube 35, and then may be introduced into the compressor 24.

However, if an amount of oil introduced into the compressor 24 is too much or too little, performance of the compressor 24 may deteriorate. Thus, it may be necessary to adjust the amount of oil introduced into the compressor 24 through the oil collection tube 33.

Figure 3:
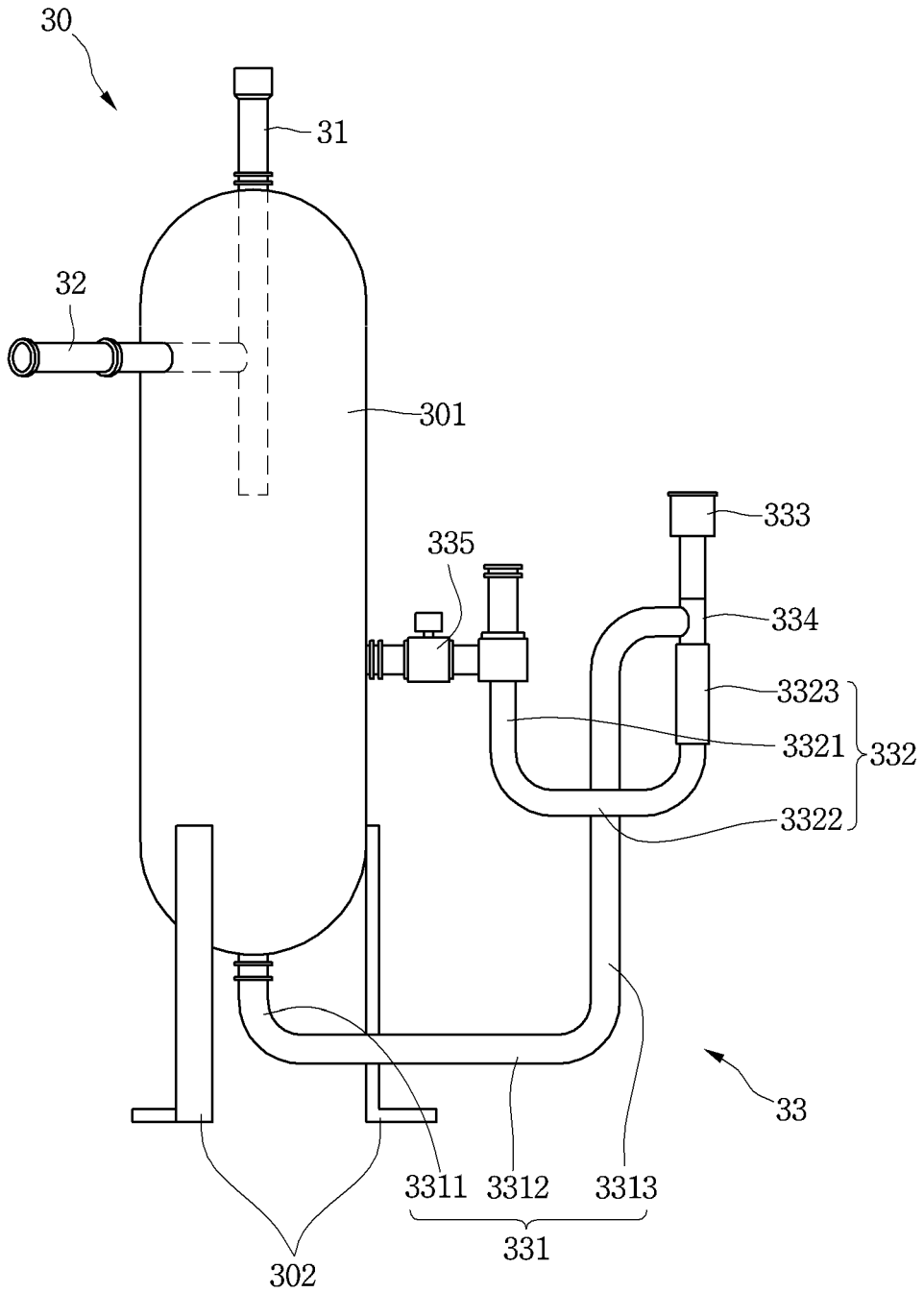
FIG. 3 is a perspective view of an oil separator of the air conditioner of FIG. 1.

FIG. 3 is a perspective view of an oil separator of the air conditioner of FIG. 1. Referring to FIG. 3, the oil separator 30 may include a housing 301, the suction tube 32, the discharge tube 31, and the oil collection tube 33.

The housing 301 may define an outer surface of the oil separator 30. The suction tube 32 may communicate with the housing 301. In more detail, the suction tube 32 may be provided in or communicate with a side surface of the housing 32 to guide the refrigerant mixed with the oil discharged from the compressor 24 into the housing 301. The discharge tube 31 may guide the refrigerant separated from the oil in the housing 301 to discharge the refrigerant to the outdoor heat exchanger 21. That is, the discharge tube 31 may be provided on or communicate with the housing 301 to provide a passage through which the refrigerant separated from the oil in the housing 301 may be discharged.

The oil collection tube 33 may provide a path through which the oil separated in the housing 301 may be collected into the compressor 24.

The oil separator 32 may further include a support 302 provided on or at a bottom surface of the housing 301 to support the housing 301. The oil collection tube 33 may include a first collection tube 331 and a second collection tube 332. The first collection tube 331 may be provided in or at the bottom surface of the housing 301 to communicate with an inside of the housing 301, thereby providing a moving path for the oil. The second collection tube 332 may be provided in or at or communicate with a side surface of the housing 301 to communicate with the inside of the housing 301, thereby providing a moving path for the oil.

That is, the oil separated in the housing 301 may be collected again into the compressor 24 through the first and second collection tubes 331 and 332. Also, the first and second collection tubes 331 and 332 may communicate with each other. A combination portion 334 may be provided on or at a position at which the first and second collection tubes 331 and 332 communicate with each other. Thus, the oil passing through the first collection tube 331 and the oil passing through the second collection tube 332 may pass through the combination portion 334 to move into a third collection tube 333 connected to the compressor 24, and then, may be introduced into the compressor 24.

Figure 4:
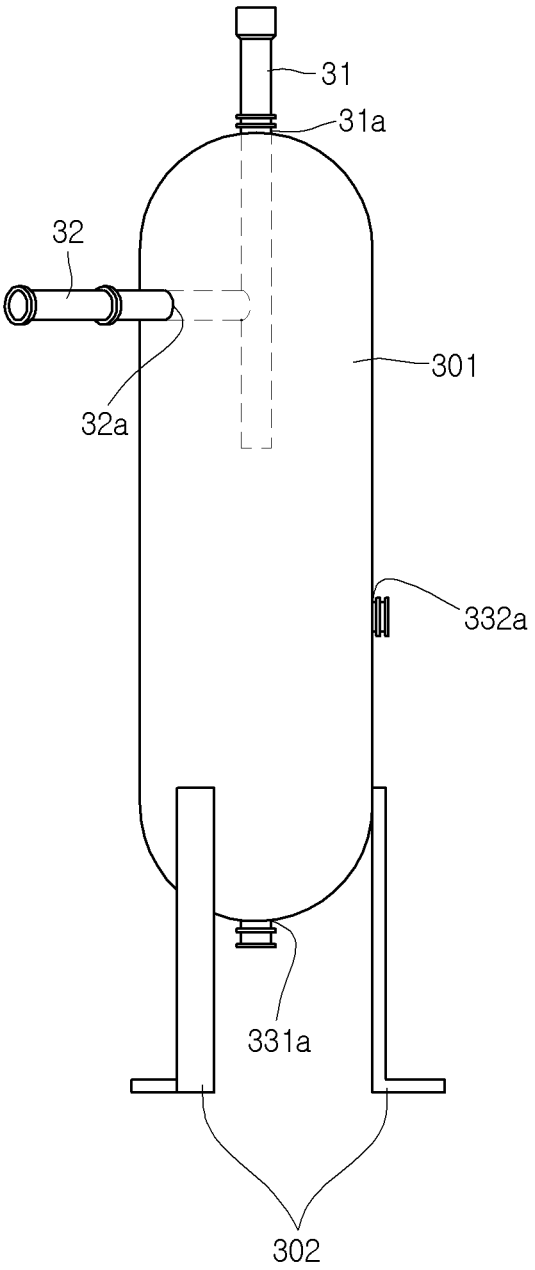
FIG. 4 is a view illustrating a plurality of holes defined in a housing of the oil separator of FIG. 3.
Figure 5:
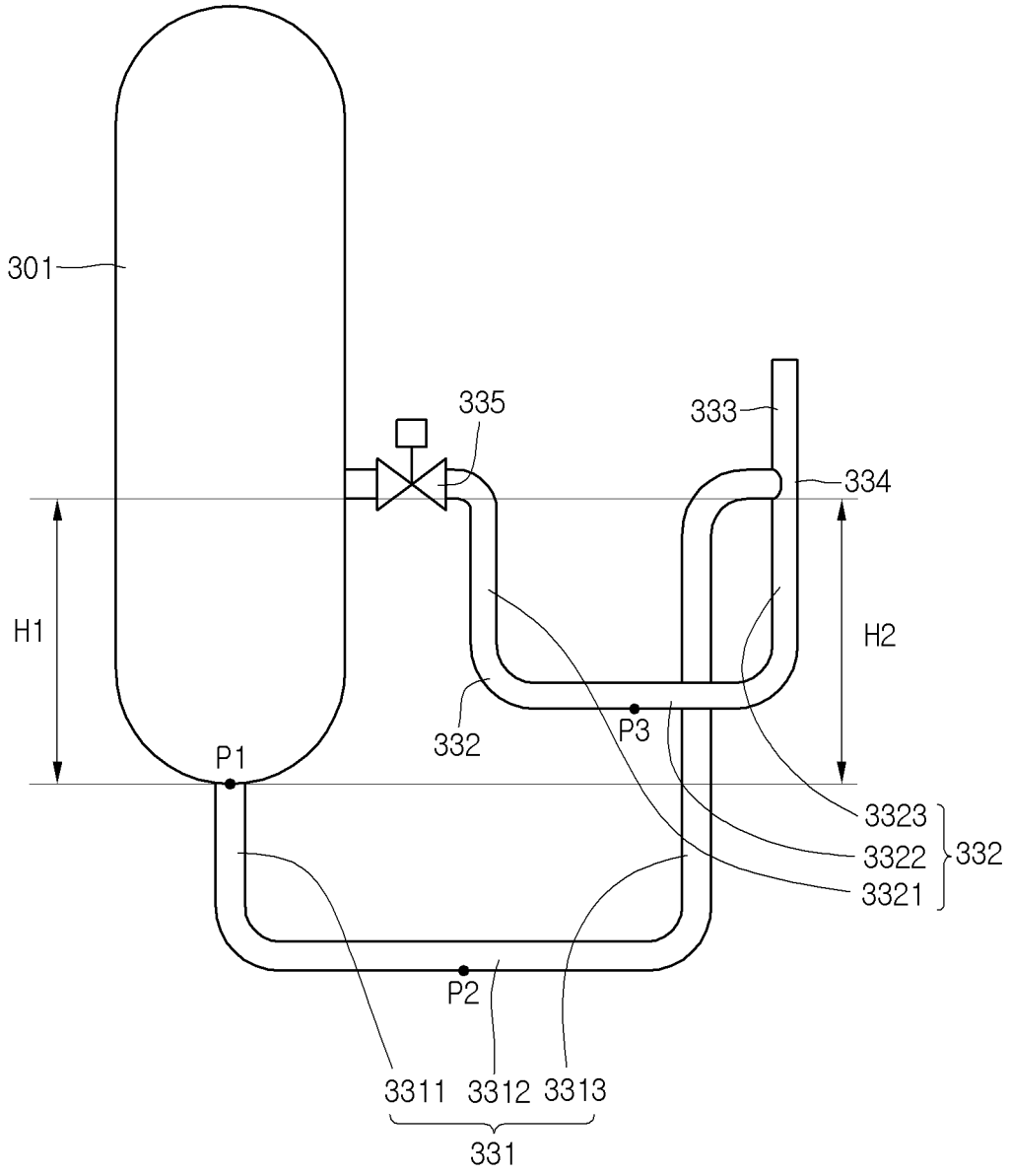
FIG. 5 is a conceptual view of the oil separator when a combination portion and a second collection hole defined in the housing of FIG. 4 have a same height.
Figure 6:
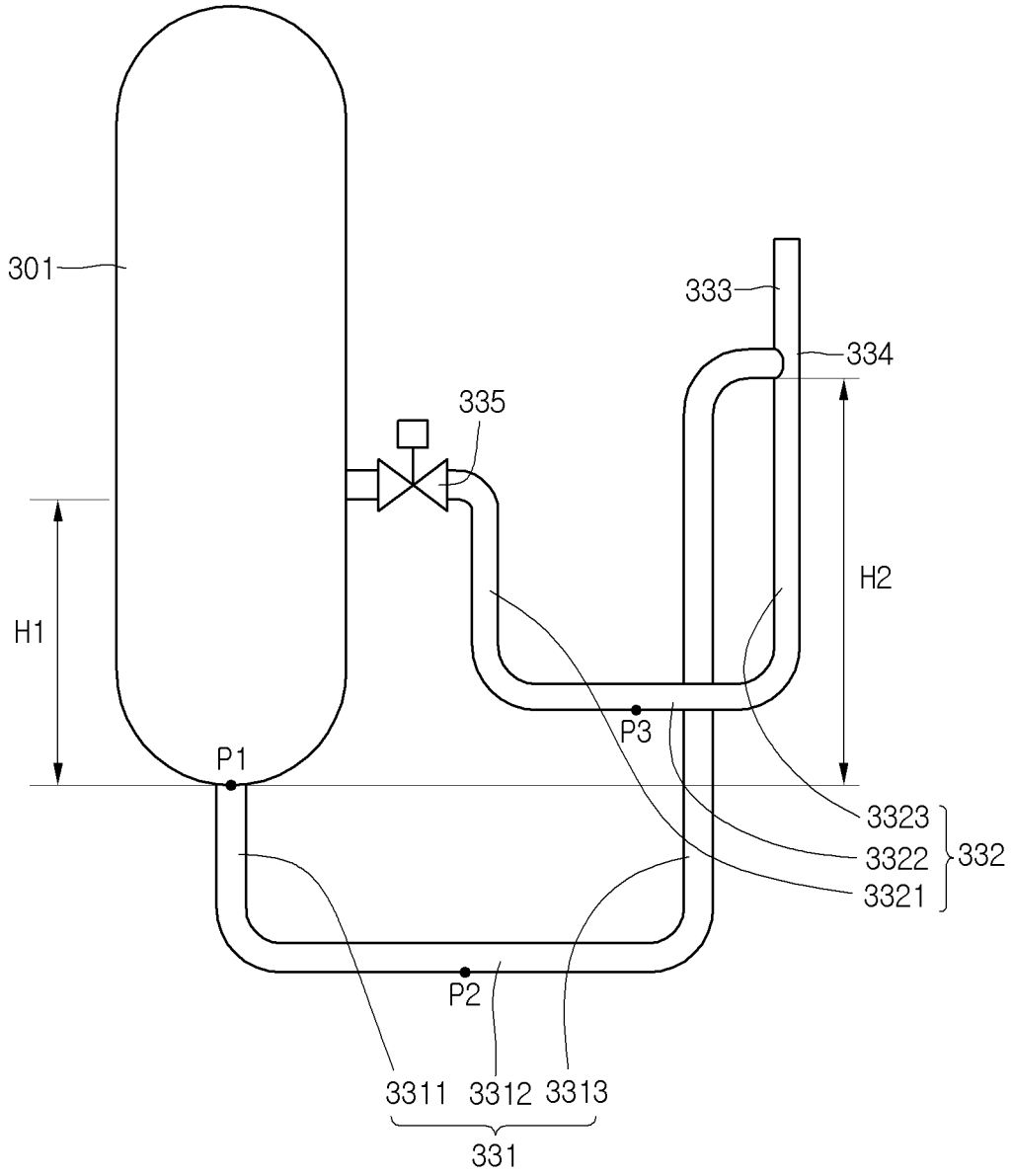
FIG. 6 is a conceptual view of the oil separator when the combination portion has a height greater than a height of the second collection hole defined in the housing of FIG. 4.

FIG. 4 is a view illustrating a plurality of holes defined in a housing of the oil separator of FIG. 3. FIG. 5 is a conceptual view of the oil separator when a combination portion and a second collection hole defined in the housing of FIG. 4 have a same height. FIG. 6 is a conceptual view of the oil separator when the combination portion has a height greater than a height of the second collection hole defined in the housing of FIG. 4.

Referring to FIGS. 4 to 6, a plurality of holes that allow the suction tube 32, the discharge tube 31, and the oil collection tube 33 to be connected to the housing 301 may be defined in the housing 301. The plurality of holes may include a suction hole 32*a*, into which a refrigerant discharged from the compressor 24 and mixed with oil may be suctioned, defined in or at a side of the housing 301. As the suction tube 32 communicates with the housing 301 through the suction hole 32*a*, the refrigerant discharged from the compressor 24 and mixed with the oil may be introduced into the housing 301 through the suction tube 32.

The plurality of holes may further include a discharge hole 31*a*, through which the refrigerant separated in the housing 301 may be discharged, defined in the housing 301. The discharge hole 31*a* may be defined in or at an upper portion of the housing 301, and the discharge tube 31 may communicate with the housing 301 through the discharge hole 31*a*. Thus, the refrigerant separated in the housing 301 may be guided by the discharge tube 31 that communicates with the discharge hole 31*a* to move into the outdoor heat exchanger 21.

The plurality of holes may further include a first collection hole 331*a* and second collection hole 332*a*, through which the oil separated in the housing 301 may be discharged, defined in the housing 301. The first collection hole 331*a* may communicate with the first collection tube 331, and the second collection hole 332*a* may communicate with the second collection tube 332.

The first collection hole 331*a* may be defined in or at the bottom surface of the housing 301. In more detail, the first collection hole 331*a* may be defined in or at a lowermost point P1 within the housing 301. This is done to completely discharge the oil in the housing 301 when an amount of oil required for or by the compressor 24 is large.

The second collection hole 332*a* may be defined in or at a side surface of the housing 301 at a position which is higher than a position of the first hole 331*a* with respect to the lowermost point P1 of the housing 301. Thus, the oil may be stored in the housing 301 to a height at which the second collection hole 332*a* is defined from the lowermost point P1 of the housing 301. This is done to store the oil in the housing 301 when the amount of oil required for or by the compressor 24 is low.

For example, as illustrated in FIG. 5, if a height from the lowermost point P1 to the second collection hole 332*a* is defined as a height H1, when a control valve 335, which will be described herein below, is opened, the oil within the housing 301 may be stored up to the height H1. The positions of the first and second collection holes 331*a* and 332*a* and the height from the lowermost point P1 to the second collection hole 332*a* may vary according to a design with respect to an amount of oil to be stored in the housing 301.

Also, a height H2 from the lowermost point P1 of the housing 301 to the combination portion 334 may be equal to the height H1 from the lowermost point P1 of the housing 301 to the second collection hole 332*a*. This is done because the amount of oil to be stored in the housing 301 may be determined by the height H1 from the lowermost point P1 of the housing 301 to the second collection hole 332*a*. That is, if the height H2 from the lowermost point P1 of the housing 301 to the combination portion 334 is less than the height H1 from the lowermost point P1 of the housing 301 to the second collection hole 332*a*, the amount of oil to be stored in the housing 301 may be less than the amount of oil to be stored according to the design.

Also, the height H2 from the lowermost point P1 of the housing 301 to the combination portion 334 may be equal to or greater than the height H1 from the lowermost point P1 of the housing 301 to the second collection hole 332*a*, so that backflow of the oil moving through the second collection tube 332 may be prevented. Referring to FIG. 6, the height H2 from the lowermost point P1 of the housing 301 to the combination portion 334 may be greater than the height H1 from the lowermost point P1 of the housing 301 to the second collection hole 332*a*, so that when the control valve 335 is opened, the oil may be stored up to only the height H1 within the housing 301. However, the oil may be stored in the first collection tube 331 by a length between the height H1 and the height H2.

The first collection tube 331 may have a shape which is sloped or extends in a downward direction and then is sloped or extends in an upward direction as the first collection tube 331 extends away from a connection position between the first collection tube 331 and the housing 301. When the first collection tube 331 is sloped or extends in the downward direction from the position at which it communicates with the housing 301, the oil may be smoothly discharged into the first collection tube 331 through the first collection hole 331*a* defined in the lowermost point P1 of the housing 301. The first collection tube 331 may include a first collection vertical tube 3311 that communicates with the first collection hole 331*a*, a first collection horizontal tube 3312 that communicates with the first collection vertical tube 3311, and a first collection combination tube 3313 that communicates with the first collection horizontal tube 3312.

The second collection tube 332 may have a shape that is sloped or extends in the downward direction and then is sloped or extends in the upward direction as the second collection tube 332 extends away from a connection position between the second collection tube 332 and the housing 301. The second collection tube 332 may include a second collection vertical tube 3321 that communicates with the second collection hole 332*a*, a second collection horizontal tube 3322 that communicates with the second collection vertical tube 3321, and a second collection combination tube 3323 that communicates with the second collection horizontal tube 3322. The combination portion 334 may be provided on or at a position at which the first collection combination tube 3313 and the second collection combination tube 3323 communicate with each other.

The control valve 335 may be provided between the second collection hole 332*a* and the second collection vertical tube 3321. The control valve 335 may control a flow of the oil within the second collection tube 332.

When the second collection tube 332 is sloped or extends in the downward direction and then sloped or extends in the upward direction as the second collection tube 332 extends away from the connection position between the second collection tube 332 and the housing 301, a predetermined amount of oil may be stored in the second collection tube 332. When the oil is supplied into the compressor 24 through the second collection tube 332, an interval between a time point at which the oil passes through the control valve 335 and a time point at which the oil reaches the compressor 24 may be minimized.

In more detail, when the control valve 335 is closed to allow the oil to move into the compressor 24 through the first collection tube 331, the second collection tube may be in a state in which oil is accommodated in the second collection tube 332. Thus, when the control valve 335 is opened to allow the oil to move into the compressor 24 through the second collection tube 332, a supply time of the oil into the compressor 24 through the second collection tube 332 may be reduced by a time taken to allow the oil passing through the control valve 335 to successively pass through the second collection vertical tube 3321 and the second collection horizontal tube 3322, thereby reaching the combination portion 334 of the second collection combination tube 3323.

The first collection horizontal tube 3312 may be provided at a position P2 lower than the lowermost point P1 of the housing 301. The second collection horizontal tube 3322 may be provided at a position P3 which is higher than the position P2 of the first collection horizontal tube 3312. This is done to prevent the oil stored in the housing 301 from being discharged into the compressor 24 through the first collection tube 331 by a difference between heads of the first and second collection tubes 331 and 332 when the second collection horizontal tube 3322 is provided at the position P3 which is lower than the position P2 of the first collection horizontal tube 3312.

Hereinafter, a flow of each of the refrigerant and oil passing through the oil separator will be described.

First, materials passing through the compressor 24 may include high-temperature, high-pressure gas refrigerant and oil. The gas refrigerant and oil passing through the compressor 24 may be referred to as an oil-mixed refrigerant. The oil-mixed refrigerant passing through the compressor 24 may be introduced into the housing 301 through the suction tube 32. The oil-mixed refrigerant may be separated into gas refrigerant and oil within the housing 301.

The refrigerant separated in the housing 301 may be discharged into the outdoor heat exchanger 21 through the discharge tube 31. The oil separated in the housing 301 may be introduced again into the compressor 24 through the oil collection tube 33.

More particularly, the oil collection tube 33 may include the first collection tube 331 and the second collection tube 332. Thus, the oil separated in the housing 301 may be introduced into the compressor 24 through the first collection tube 331 or the second collection tube 332.

When the control valve 335 is opened, an internal suction pressure of the second collection tube 332 may be increased higher than a pressure of the first collection tube 331 to allow the oil to move into only the second collection tube 332. On the other hand, when the control valve 335 is closed, the internal suction pressure of the second collection tube 332 may be decreased less than the pressure of the first collection tube 331 to allow the oil to move into only the first collection tube 331. That is, a passage through which the oil moves from the inside of the housing 301 to the compressor 24 may vary according to whether the control valve 335 is opened or closed.

Figure 7:
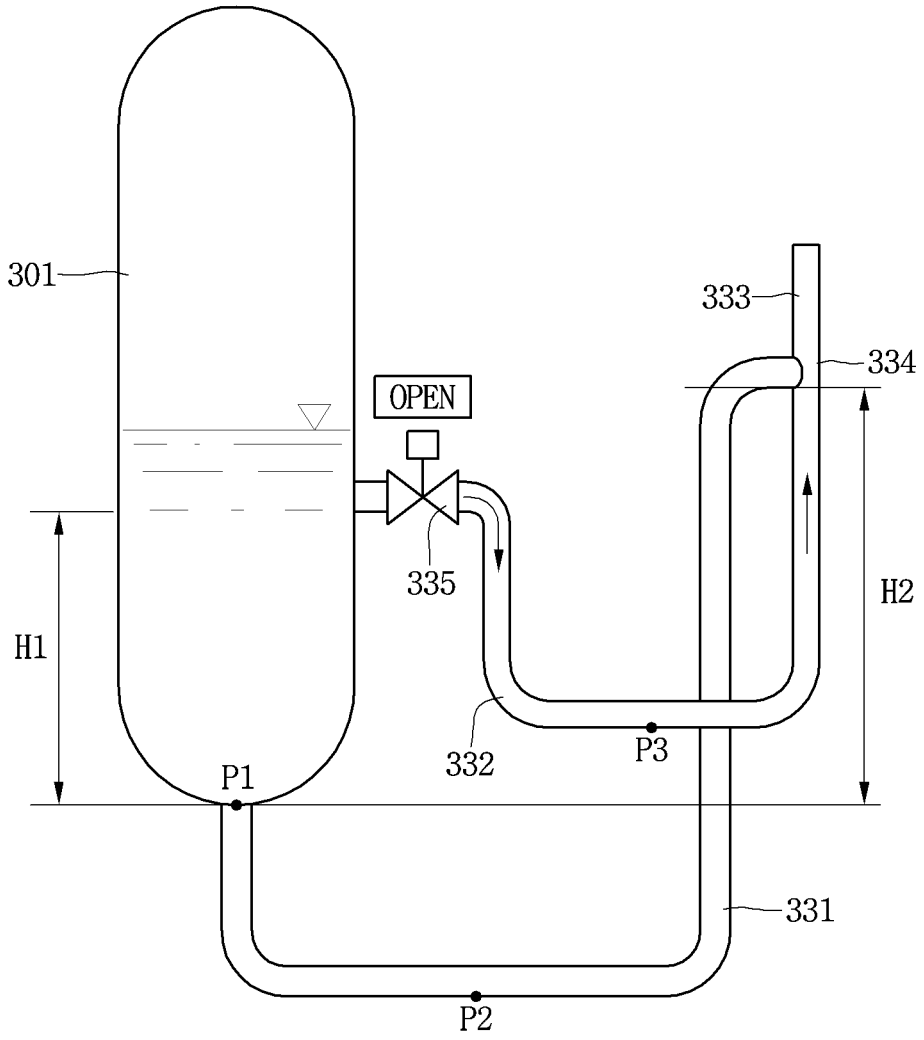
FIG. 7 and FIG. 8 are views illustrating a moving direction of oil passing through an oil collection tube according to an opening or closing of a control valve.
Figure 8:
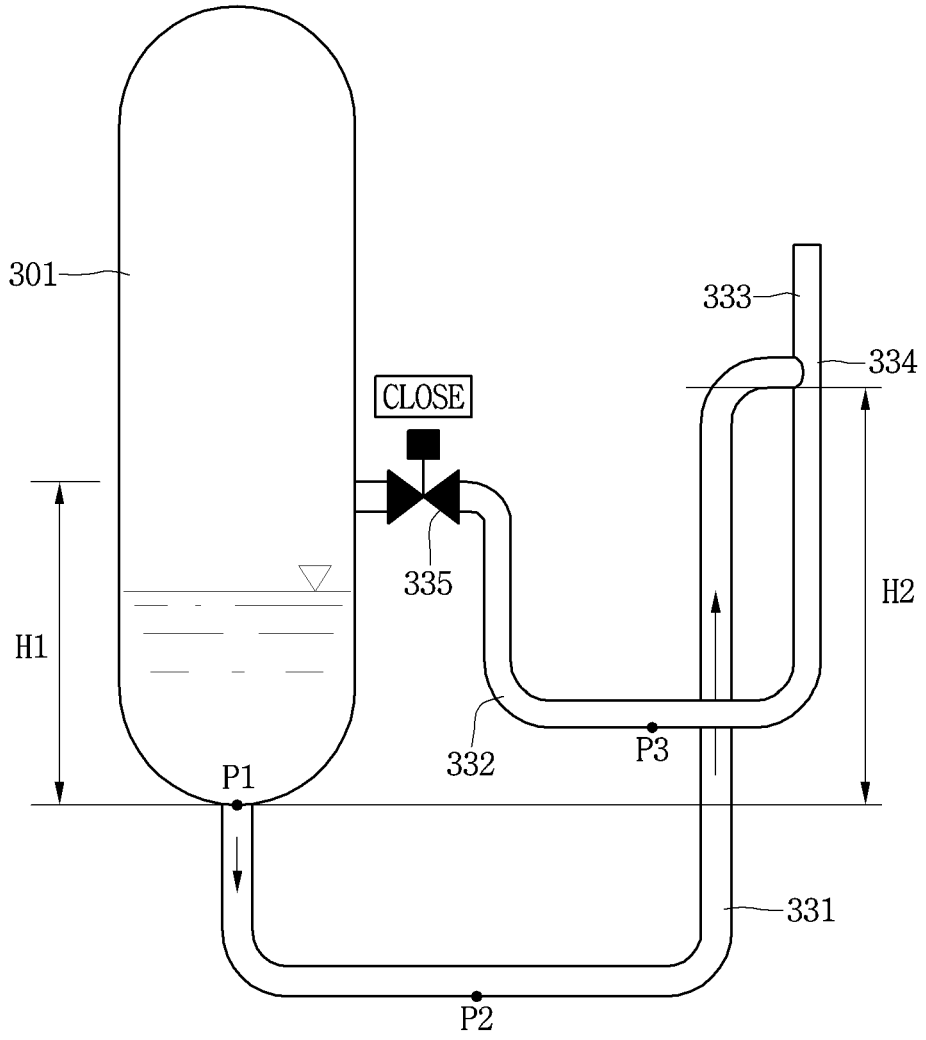

FIG. 7 and FIG. 8 are views illustrating a moving direction of oil passing through an oil collection tube according to an opening or closing of a control valve. Hereinafter, a moving direction of oil that moves into the compressor through the first collection tube or the second collection tube according to an amount of oil accommodated in the housing will be described with reference to FIGS. 7 and 8.

The moving direction of the oil introduced into the oil separator 30 may vary according to an amount of oil accommodated in the oil separator 30. That is, when the oil is collected from the oil separator 30 in a direction of the compressor 24, the oil may move along the first collection tube 331 or the second collection tube 332, which both communicate with the housing 301. The oil may move through one of the first collection tube 331 or the second collection tubes 332 according to an opening and closing of the control valve 335.

First, as illustrated in FIG. 7, when the control valve 335 provided in the second collection tube 332 is opened, the oil accommodated in the housing 301 may move into the compressor 24 through the second collection tube 332. In more detail, the oil accommodated at a height which is greater than the height H1 of the second collection hole 332*a* within the housing 301 may move into the compressor 24 through the second collection tube 332. That is, the oil accommodated at a position which is less than the height H1 of the second collection hole 332*a* may be stored in the housing 301, and only the oil accommodated at the height which is greater than the height H1 of the second collection hole 332*a* may move into the compressor 24 through the second collection tube 332.

On the other hand, as illustrated in FIG. 8, when the control valve 335 is closed, the oil accommodated in the housing 301 may move into the compressor 24 through only the first collection tube 331. That is, the oil may move into the compressor 24 through the first collection tube 331 regardless of the height of the oil accommodated in the housing 310.

When an amount of oil required for the compressor 24 is relatively large, the oil separator 30 may be controlled to close the control valve 335 so that the oil accommodated in the housing 301 may completely move into the compressor 24 along the first collection tube 331. On the other hand, if an amount of oil that is required for the compressor 24 is relatively little, the oil separator 30 may be controlled to open the control valve 335 so that only the oil accommodated at the position which is greater than the height H1 of the second collection hole 332*a* may move into the compressor 24 along the second collection tube 332.

However, embodiments are not limited to the installed position of the control valve 335. That is, the control valve 335 may be provided in the first collection tube 331.

The air conditioner according to an embodiment may include an oil sensor (not shown) provided within the compressor 24 to measure an oil level within the compressor 24 in real time, and a memory (not shown) in which information with respect to an amount of oil required for the compressor 24 may be mapped or stored.

The air conditioner may further include a controller 500 that controls an opening and closing of the control valve 335 according to an amount of oil required for the compressor 24. More particularly, the controller 500 may compare information with respect to the amount of oil required for the compressor 24, which is previously stored in the memory (not shown), to a present amount of oil stored in the oil separator 30 to control the opening and closing of the control valve 335. In more detail, the controller (not shown) may close the control valve 335 when the amount of oil required for the compressor 24 is greater than a preset or predetermined amount to discharge the oil within the housing 301 into the first collection tube 331 to the compressor 24.

Also, the controller (not shown) may open the control valve 335 when the amount of oil required for the compressor 24 is less than the preset or predetermined amount to discharge only the oil within the housing 301, which may be provided at the position which is higher than the position at which the housing 301 and the second collection tube communicate with each other, to the compressor 24 through the second collection tube.

In the oil separator according to embodiments and the air conditioner including an oil separator according to embodiments, oil may be selectively stored in the oil separator to adequately control an amount of oil within the compressor. The amount of oil required for the compressor may be controlled in real time to improve efficiency of the compressor. Also, when the control valve is opened to collect the oil into the compressor through the second collection tube, a collection period of the oil flowing into the compressor may be reduced.

Embodiments disclosed herein provide an oil separator in which oil may be selectively stored to adequately control an amount of oil discharged from an oil separator to a compressor so that the compressor may smoothly operate.

Embodiments disclosed herein provide an oil separator that may include a housing including a suction tube that guides a refrigerant, in which an oil may be mixed, into the housing and a discharge tube that discharges a refrigerant separated from the refrigerant, in which the oil may be mixed, to the outside; a first collection tube that communicates with a lower portion of the housing to discharge the oil separated from the refrigerant, in which the oil may be mixed, into a compressor; a second collection tube that communicates with a side surface of the housing to discharge the oil separated from the refrigerant, in which the oil may be mixed, into the compressor; and a control valve disposed or provided in the first or second collection tube to control a flow of the oil flowing through the first or second collection tube. The second collection tube may be sloped or extend downward and then sloped or extend upward in a direction that is away from a position thereof which communicates with the housing, and ends of the first and second collection tubes may be combined or coupled with each other.

The first collection tube may communicate with a lowermost point within the housing. The first collection tube may be sloped or extend downward and then sloped or extend upward in a direction that is away from a position thereof which communicates with the housing. A height from the lowermost point within the housing to the position of the second collection tube which communicates with the housing may be less than that from the lowermost point within the housing to a position at which the ends of the first and second collection tubes are combined with each other.

The first collection tube may include a first collection vertical tube that communicates with the lower portion of the housing and is sloped or extends downward; a first collection horizontal tube that communicates with the first collection vertical tube; and a first collection combination tube that communicates with the first collection horizontal tube and is sloped or extends upward. The second collection tube may include a second collection vertical tube that communicates with the side surface of the housing and is sloped or extends downward; a second collection horizontal tube that communicates with the second collection vertical tube; and a second collection combination tube that communicates with the second collection horizontal tube and is sloped or extends upward.

Ends of the first collection combination tube and the second collection combination tube may be combined or coupled with each other. The first collection horizontal tube may be disposed or provided at a position which is lower than the lowermost point within the housing. The second collection horizontal tube may be disposed or provided at a position which is higher than that of the first collection horizontal tube.

The oil separator may further include a controller connected to the control valve to determine an opening or closing of the control valve based on an amount of oil that is required for the compressor. The controller may close the control valve to discharge the oil within the housing into the compressor through the first collection tube when the amount of oil that is required for the compressor is greater than a predetermined amount. The controller may open the control valve to discharge the oil within the housing, which is disposed or provided at a position which is higher than that at which the housing and the second collection tube communicate with each other, into the compressor through the second collection tube when the amount of oil that is required for the compressor is less than a predetermined amount. The controller may close the control valve such that the oil stored in the housing may be discharged into the compressor through the first collection tube.

When the controller opens the control valve, oil stored in the housing, which is disposed or provided at a position which is higher than that at which the housing and the second collection tube communicate with each other, may be discharged into the compressor through the second collection tube.

The suction tube may be disposed or provided in or at the side surface of the housing, and the discharge tube may be disposed or provided in or at an upper portion of the housing.

Embodiments disclosed herein further provide an air conditioner including an oil separator that may include a compressor that compresses a refrigerant; an oil separator that separates an oil from the refrigerant, which may be discharged from the compressor and mixed with the oil, to collect the separated oil into the compressor; and a condenser that condenses the refrigerant separated in the oil separator. The oil separator may include a housing including a suction tube that guides the refrigerant, in which the oil may be mixed, into the housing and a discharge tube that discharges the refrigerant separated from the refrigerant, in which the oil may be mixed, into the condenser; a first collection tube that communicates with a lower portion of the housing to discharge the oil separated from the refrigerant, in which the oil may be mixed, into the compressor; a second collection tube that communicates with a side surface of the housing to discharge the oil separated from the refrigerant, in which the oil may be mixed, into the compressor; and a control valve disposed or provided in the first collection tube or the second collection tube to control a flow of the oil flowing through the first or second collection tube. The second collection tube may be sloped or extend downward and then sloped or extend upward in a direction that is away from a position thereof which communicates with the housing, and ends of the first and second collection tubes may be combined with each other.

The first collection tube may communicate with a lowermost point within or of the housing. The first collection tube may be sloped or extend downward and then sloped or extend upward in a direction that is away from a position thereof which communicates with the housing. A height from the lowermost point within the housing to the position of the second collection tube which communicates with the housing may be less than that from the lowermost point within the housing to a position at which the ends of the first and second collection tubes are combined with each other.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An oil separator, comprising:

a housing including a suction tube that guides a refrigerant, in which an oil is mixed, into the housing and a discharge tube that discharges the refrigerant separated from the oil to the outside;

a first collection tube that communicates with a lower portion of the housing to discharge the oil separated from the refrigerant to a compressor;

a second collection tube that communicates with a side surface of the housing to discharge the oil separated from the refrigerant to the compressor, wherein the second collection tube includes a second collection vertical tube that communicates with a side surface of the housing and is sloped in a downward direction;

a single control valve, the control valve being provided in the second collection tube between the housing and the second collection vertical tube to control a flow of the oil through the first and second collection tubes;

a combination portion provided at a position at which the first and second collection tubes communicate with each other;

a third collection tube that communicates with the combination portion to discharge the oil flowing from the first collection tube or the second collection tube to the compressor, wherein the housing includes a first collection hole that communicates with the first collection tube and a second collection hole that communicates with the second collection tube, and wherein a height from the first collection hole to the combination portion is equal to or higher than a height from the first collection hole to the second collection hole; and a controller connected to the control valve to determine an opening or closing of the control valve based on an amount of oil required by the compressor, wherein the second collection tube further includes a second collection horizontal tube coupled to the second collection vertical tube and the second collection horizontal tube is provided at a position which is higher than a position of the first collection hole, and:

when the controller closes the control valve, oil is stored in the second collection horizontal tube, and oil within the housing is discharged into the compressor through the first collection tube when an amount of oil required by the compressor is greater than a predetermined amount, and when the controller opens the control valve, oil stored in the housing at a position higher than the second collection hole is discharged to the compressor through the second collection tube when the amount of oil required for the compressor is less than the predetermined amount.

2. The oil separator according to claim 1, wherein the first collection tube communicates with a lowermost point of the housing.

3. The oil separator according to claim 1, wherein the first collection tube and second collection tube are sloped in the downward direction and then sloped in the upward direction away from a position at which the first or second collection tube communicates with the housing.

4. The oil separator according to claim 1, wherein the first collection tube includes:

a first collection vertical tube that communicates with the lower portion of the housing and is sloped in the downward direction;

a first collection horizontal tube that communicates with the first collection vertical tube; and a first collection combination tube that communicates with the first collection horizontal tube and is sloped in the upward direction.

5. The oil separator according to claim 4, wherein the second collection tube further includes a second collection combination tube that communicates with the second collection horizontal tube and is sloped in the upward direction.

6. The oil separator according to claim 5, wherein ends of the first collection combination tube and the second collection combination tube are coupled.

7. The oil separator according to claim 6, wherein the first collection horizontal tube is provided at a position which is lower than the lowermost point of the housing.

8. The oil separator according to claim 6, wherein the second collection horizontal tube is provided at a position which is higher than a position of the first collection horizontal tube.

9. The oil separator according to claim 1, wherein the suction tube is provided in a side surface of the housing, and wherein the discharge tube is provided in an upper portion of the housing.

10. An air conditioner including the oil separator according to claim 1.

11. The oil separator according to claim 1, further comprising a guide tube having a first end connected to the compressor and a second end connected to an accumulator, wherein the third collection tube is coupled to the guide tube at a position between the first and second ends, wherein the guide tube guides the introduction of refrigerant into the compressor and the oil guided along the first, second, and third collection tubes is mixed with the refrigerant passing through the guide tube before being introduced into the compressor.

12. The oil separator according to claim 1, wherein the first collection tube includes a first collection vertical tube that communicates with the first collection hole, a first collection horizontal tube that communicates with the first collection vertical tube, and a first collection combination tube that communicates with the first collection horizontal tube.

13. The oil separator according to claim 12, wherein the second collection vertical tube communicates with the second collection hole, the second collection horizontal tube communicates with the second collection vertical tube, and a second collection combination tube communicates with the second collection horizontal tube.

14. The oil separator according to claim 13, wherein the combination portion is provided at a position at which the first collection combination tube and the second collection combination tube communicate with each other.

15. The oil separator according to claim 13, wherein the first collection horizontal tube is provided at a position that is lower than the lowermost point of the housing.

16. The oil separator according to claim 15, wherein the second collection horizontal tube is provided at a position which is higher than the position of the first collection horizontal tube.

17. The oil separator of claim 16, wherein the control valve is provided between the second collection hole and the second collection vertical tube.

* * * * *